US006123590A

United States Patent [19]

Nakamura

[11] Patent Number: 6,123,590

[45] Date of Patent: Sep. 26, 2000

[54] TILT LOCK DEVICE FOR OUTBOARD MOTOR

[75] Inventor: Tamotsu Nakamura, Saitama, Japan

[73] Assignee: Showa Corporation, Saitama, Japan

[21] Appl. No.: 09/135,701

[22] Filed: Aug. 18, 1998

[30] Foreign Application Priority Data

Feb. 12, 1998 [JP] Japan ..... 10-030174

[51] Int. Cl.[7] ..... B63H 5/125

[52] U.S. Cl. ..... 440/56; 440/61

[58] Field of Search ..... 114/55, 56, 61, 114/53

[56] References Cited

U.S. PATENT DOCUMENTS 4,944,705 7/1990 Kashima et al. ..... 440/61
5,876,259 3/1999 Nakamura ..... 440/56

FOREIGN PATENT DOCUMENTS 63-64891 3/1988 Japan .
0258155 6/1990 Japan .
0045195 9/1992 Japan .

*Primary Examiner*—Sherman Basinger
*Attorney, Agent, or Firm*—Dvorak & Orum

[57] ABSTRACT

A tilt lock device 10 comprises a piston 13 having a piston rod 14, an inner cylinder 12 defining the piston 13 into an upper oil chamber S1 and a lower oil chamber S2, and an outer cylinder 11 surrounding the inner cylinder 12. A communication passage 34 is formed in the piston 13 for bringing the upper and lower oil chambers S1 and S2 into communication with each other, and an on-off valve 15 capable of being operated from outside is disposed in the communication passage 34 for preventing oil from flowing from the lower oil passage S2 into the upper oil passage S1, and for also serving as a shock absorbing valve which allows oil to flow from the upper oil chamber S1 to the lower oil chamber S2 when a pressure in the upper oil chamber S1 exceeds a set pressure so as to absorb a shock. An accumulator chamber S3 is formed between the outer and inner cylinders 11 and 12 for also serving as a volume compensation chamber which controls the volume of the oil going in and out through the lower oil chamber S2 following in-and-out movement of the piston rod 14.

3 Claims, 8 Drawing Sheets

14
S4
16c
16a
16m
16
16b
15g
15j
15b
15d
15
13
16n
S1
S2
15f
14a
15k
15m
16a
16
15b
15
13
15e
15c
16e
S5
15b
15h
16b
15k
15
13

TILT LOCK DEVICE FOR OUTBOARD MOTOR

BACKGROUND OF THE INVENTION

1. Field of the Invention

The present invention relates to an improvement of a tilt lock device for an outboard boat motor.

2. Description of the Related Art

A prior art tilt lock device for an outboard motor is shown in (1) Japanese Patent Application Publication (JP-B) No. 2-58155 (TILT LOCK DEVICE FOR OUTBOARD MOTOR) and (2) Japanese Patent Application Laid-open (JP-A) No. 4-5195 (TILT CYLINDER DEVICE FOR OUTBOARD MOTOR).

The prior art reference (1) reduces a tilt-up operation force by a simple structure in addition to a basic function of the tilt lock device. As shown in FIGS. 4 and 5 of this publication, this device comprises a cylinder 8, a piston 12 movably inserted in the cylinder 8, a rod 11 as a piston rod mounted to the piston 12, first and second chambers 8*a* and 8*b* as oil chambers defined on opposite sides of the piston 12, a communication passage 24 for interconnecting these first and second chambers 8*a* and 8*b* with each other outside the cylinder 8 to bypass the piston 12, a switch valve 37 provided in an intermediate portion of the communication passage 24, a tank 45 connected to the switch valve 37, and a gas chamber 38 constituting an operation force device in the tank 45 to compensate the volume in the cylinder 8 with advancing and retreating movement of the rod 11.

The prior art reference (2) discloses a tilt lock device having substantially the same function as the prior art (1), and prevents the outboard body from being damaged when an excessive external force is applied to the outboard body during forward travel or reverse travel in the shallow. As shown in FIG. 3 in this publication, this device comprises a tilt cylinder device 10 including a piston 13 vertically movably inserted in a cylinder 11, a free piston 14 disposed above the piston 13, a piston rod 12 mounted to a lower portion of the piston 13, and a gas chamber 15 disposed above the free piston 14 in the cylinder 11.

In the prior art (1), since the tank 45 and the cylinder 8 are separate members, the tilt lock device occupies a large space. Further, since the communication passage 24 is extended from the cylinder 8 outward, and the tank 45 is further connected to the switch valve 37 provided at an intermediate portion of the communication passage 24, there is a problem with the assembling operation.

In the prior art (2), since the gas chamber 15 is provided at an upper portion in the cylinder 11, the entire length of the cylinder 11 is long and therefore, there is a problem, because the a length required for mounting the tilt cylinder device 10 is long.

SUMMARY OF THE INVENTION

Thereupon, it is an object of the present invention to provide a compact tilt lock device for an outboard motor in which an external communication passage is unnecessary and the manufacturing cost can be reduced.

To achieve the above object, according to the present invention, there is provided a tilt lock device for an outboard motor in which an outboard motor is mounted to a boat stern, the outboard motor can be stopped at an arbitrary position when the outboard motor is swung from its in-use position to its stand-by position, a tilt lock device is interposed between the stern and the outboard motor in order to moderate a shock received by the motor during running, wherein the tilt lock device comprises a piston having a piston rod, an inner cylinder accommodating the piston for vertical movement and defining the piston into an upper oil chamber and a lower oil chamber, and an outer cylinder surrounding the inner cylinder, a communication passage formed in the piston for interconnecting upper and lower oil chambers, an on-off valve capable of being operated externally is disposed in the communication passage for preventing oil from flowing from the lower oil chamber into the upper oil chamber, and for also serving as a shock absorbing valve which allows the oil to flow from the upper oil chamber to the lower oil chamber when a pressure in the upper oil chamber exceeds a set pressure so as to absorb a shock, an accumulator chamber formed between the outer and inner cylinders for serving as a volume compensation chamber which controls volume of the oil going in and out through the lower oil chamber following in-and-out movement of the piston rod.

BRIEF DESCRIPTION OF THE DRAWINGS

The present invention will be understood more fully from the detailed description given hereinbelow and from the accompanying drawings of the preferred embodiments of the invention, which are given by way of example only, and are not intended to limit the present invention.

In the drawings.

DESCRIPTION OF THE PREFERRED EMBODIMENTS

An embodiment of the present invention will be explained with reference to the accompanying drawings. The drawings should be seen in the direction of reference numbers and symbols.

Figure 1:
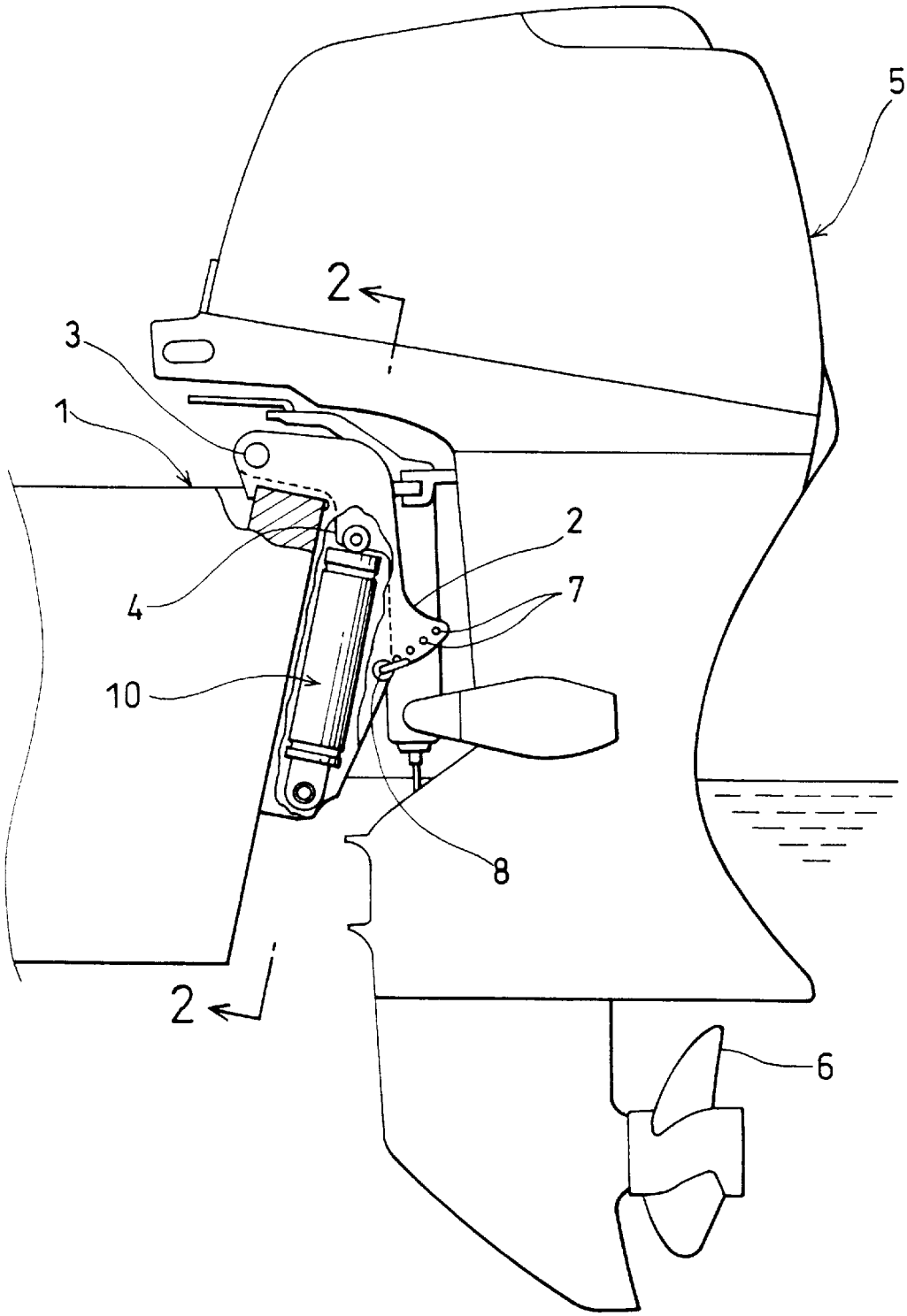
FIG. 1 is a side view showing a state where the tilt lock device of the present invention is mounted between a boat stem and an outboard motor.

FIG. 1 is a side view showing a state where a tilt lock device of the present invention is mounted between a boat stern and an outboard motor. Stern bracket 2 is attached to stern 1, a swivel bracket 4 is mounted on the stern bracket 2 such that the swivel bracket 4 can rotate vertically around a horizontal shaft 3. An outboard motor 5 is mounted on the swivel bracket 4, and a tilt lock device 10 is provided between the stern bracket 2 and the swivel bracket 4. The reference number 6 denotes a propeller of the outboard motor 5, the reference numbers 7 . . . (" . . . " means the plural, the same is true hereinafter) denote position adjusting holes opened at rear portions of the stern bracket 2. The reference number 8 denotes a stopper pin used for adjusting a tilt-down position of the outboard motor 10 by selectively inserting the stopper pin into one of the position adjusting holes 7 . . . .

Figure 2:
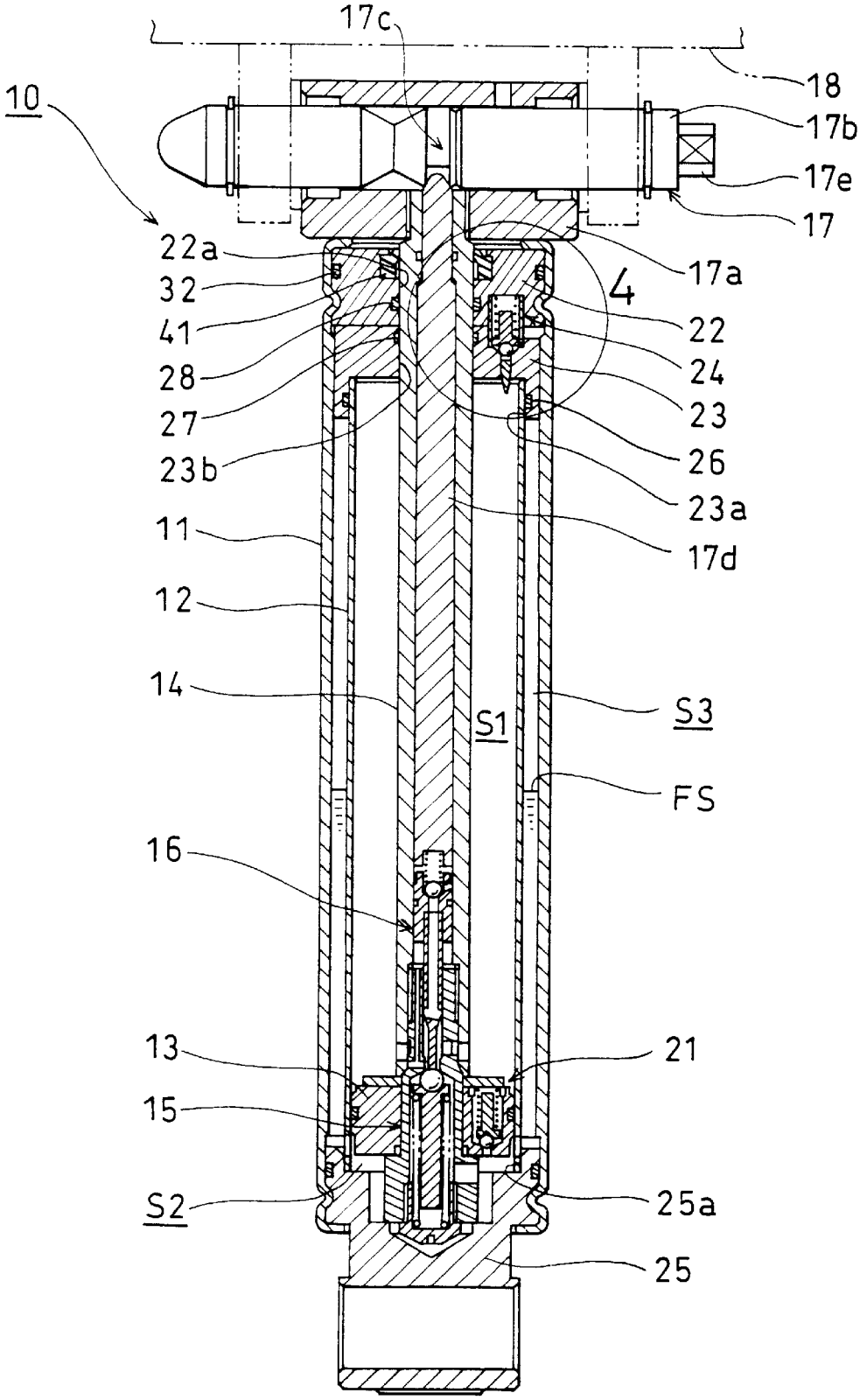
FIG. 2 is a sectional view taken along the line 2—2 in FIG. 1.

FIG. 2 is a sectional view taken along the line 2—2 in FIG. 1. The tilt lock device 10 has an outer cylinder 11, an inner cylinder 12 disposed inside of the outer cylinder 11, a piston 13 vertically movably inserted into the inner cylinder 12, a hollow piston rod 14 mounted to the piston 13, a first relief valve 15 as an on-off valve provided in the hollow piston rod 14, a delay device 16 for delaying a closing timing of the first relief valve 15, and a manual operation device 17 for opening and closing the first relief valve 15 through the delay device 16. The reference number 18 denotes an upper mounting member for mounting an upper portion of the manual operation device 17 to the swivel bracket 4 (see FIG. 1) such that the manual operation device 17 can rotate.

The tilt lock device 10 has a second relief valve 21 mounted in the piston 13, a rod guide 22 as a closing member supporting the hollow piston rod 14 at an upper portion of the outer cylinder 11, an upper block 23 for holding an upper portion of the inner cylinder 12 at a lower portion of the rod guide 22, a vent valve 24 sandwiched between the rode guide 22 and the upper block 23, and a lower block 25 mounted to the outer cylinder 11 for holding a lower portion of the inner cylinder 12.

The reference number 22*a* denotes a penetration hole of the rod guide 22 through which the hollow piston rod 14 passes. Reference number 23*a* denotes a recess of the upper block 23. Reference number 23*b* denotes a penetration hole of the upper block 23 through which the hollow piston rod 14 passes. Reference number 25*a* denotes a recess of the lower block 25, and reference numbers 26, 31, 32 and 33 denote O-rings while 27,28 denote O-rings as sealing members.

The tilt lock device 10 further has upper and lower oil chambers S1 and S2 defined in the inner cylinder 12 by the piston 13. Accumulator S3 acts as an accumulator chamber between the outer and inner cylinders 11 and 12 for also serving as a volume compensation chamber.

The manual operation device 17 has a base 17*a* connected to an upper portion of the hollow piston rod 14. A camshaft 17*b* is rotatably connected to the base 17*a*. A cam portion 17*c* is formed in the camshaft 17*b* and the operation rod 17*d* for vertical movement in the hollow piston rod 14 to follow a peripheral surface of the cam portion 17*c*. The reference number 17*e* denotes a hexangular end for mounting a handle which is not shown.

The lower block 25 also serves as a mounting member for mounting a lower end of the tilt lock device 10 to the stern bracket 2 (see FIG. 1).

Gas having a pressure higher than atmospheric pressure is sealed in an upper portion of the accumulator S3, and a lower portion thereof is filled with hydraulic fluid. The accumulator S3 is connected with the lower oil chamber S2 through an oil hole 12*a* (see FIG. 3) at a lower end of the inner cylinder 12.

When the hollow piston rod 14 is inserted into the inner cylinder 12 by the accumulator S3, hydraulic fluid in an amount corresponding to a volume of the hollow piston rod 14 moves into the accumulator S3 from the upper and lower oil chambers S1 and S2 so that oil level FS rises, and when the hollow piston 14 is pulled out from the inner cylinder 12, the hydraulic fluid in an amount corresponding to a volume of the hollow piston rod 14 moves from in the accumulator S3 into the upper and lower oil chambers S1 and S2 so that the oil level FS is lowered, thereby compensating the volume variation of the hydraulic fluid in the upper and lower oil chambers S1 and S2.

The assembling method of the tilt lock device 10 will be explained below.

(1) The operation rod 17*d* of the manual operation device 17 and the delay device 16 are inserted into the hollow piston rod 14, and the hollow piston rod 14 is connected to the piston 13 by the first relief valve 15.

(2) The components assembled in (1) are inserted in the inner cylinder 12.

(3) An upper end of the hollow piston rod 14 is inserted into the penetration hole 23*b* of the upper block 23, and an upper end of the inner cylinder 12 is inserted into the recess 23*a* of the upper block 23 through the O-ring 26. In this case, the upper end of the inner cylinder 12 and the recess 23*a* are set to form a loose fit.

(4) The components assembled in (3) are inserted into the outer cylinder 11, and the vent valve 24 is attached to the upper block 23.

(5) An upper end of the hollow piston rod 14 is inserted into the penetration hole 22*a* of the rod guide 22, the rod guide 22 is inserted into the outer cylinder 11, and the vent valve 24 is sandwiched between the upper block 23 and the rod guide 22.

(6) The manual operation device 17, except the operation rod 17*d*, is connected to the upper end of the hollow piston rod 14.

(7) The lower block 25 is inserted into the outer cylinder 11, and the lower end of the inner cylinder 12 is inserted into the recess 25*a* of the lower block 25. In this case, the lower end of the inner cylinder 12 and the recess 25*a* are set to form a tight fit or a loose fit.

(8) The lower portion of the outer cylinder 11 is fixed to an outer peripheral surface of the lower block 25 by bending inwardly, and the upper portion of the outer cylinder 11 is fixed to an outer peripheral surface of the rod guide 22 by bending inwardly.

Before assembling, the O-ring 27, the O-rings 28 and 32, the O-rings 37 and 38 (see FIG. 3 for the O-rings 37 and 38), the O-ring 39 (see FIG. 3) and a duct seal 41 (see FIG. 4A) should be mounted to the upper block 23, the rod guide 22, the piston 13, the lower block 25 and the rod guide 22, respectively.

With the above described operations, the assembling of the tilt lock device 10 is completed.

In this manner, the tilt lock device 10 is formed of piston 13 with hollow piston rod 14, the inner cylinder 12 vertically movably accommodating the piston 13 and having upper and lower oil chambers S1 and S2 defined by the piston 13. The outer cylinder 11 surrounds as the inner cylinder 12. The communication passage 34 for connecting the upper and lower oil chambers S1 and S2 is formed in the piston 13 and the hollow piston rod 14. Disposed in the communication passage 34 is the first relief valve 15 which can be operated from outside and prevents the oil from flowing from the lower oil chamber S2 to the upper oil chamber S2, and which serves as a shock absorbing valve for allowing oil to flow from the upper oil chamber S1 to the lower oil chamber S2 when a pressure in the upper oil chamber S1 exceeds a set pressure, thereby absorbing a shock. The accumulator S3 is formed between the outer cylinder 11 and the inner cylinder 12 for serving as the volume compensating chamber to control volume of oil passing in and out through the lower oil chamber S2 such as to follow the in-and-out movement of the hollow piston rod 14. Therefore, the space occupied by the tilt lock device 10 is reduced, and the length required for mounting the tilt lock device 10 is also reduced. Further, any external communication passage to be connected to outside from the outer and inner cylinders 11 and 12 is unnecessary.

Therefore, a flexibility in design for mounting the tilt lock device 10 between the stern 1 and the outboard motor 5 is enhanced and thus, the flexibility in design of shapes of the stern bracket 2, the swivel bracket 4 and the outboard motor 5 to be mounted to the opposite ends of the tilt lock device 10 is also enhanced.

Further, this tilt lock device 10 itself is compact, the length required for mounting the same is reduced and therefore, it is easy to transport or handle the device 10 at the time of maintenance or for assembling.

Furthermore, since an external communication passage is unnecessary, it is unnecessary to route the pipe or to cast or mold a communication passage integrally in the cylinder. The tilt lock device 10 can be assembled easily and the cost is reduced.

From the above reasons, the cost required for the structure of outboard motor 5 including the tilt lock device 10 and brackets 2 and 4 can be reduced.

In addition, since the outer cylinder 11 and the inner cylinder 12 are assembled by inserting the inner cylinder 12 into the lower blocks 23 and 25, and the outer cylinder 11 is bent inwardly to the rod guide 22 and the lower block 25 as described with reference to FIG. 2, and since the inner cylinder 12 is provided at its lower end with the communication hole 12*a*, the inner cylinder 12 can be roughly fitted to the lower block 25. Since the O-ring 26 is used on the upper end of the inner cylinder 12, the inner cylinder 12 can be loosely fitted to the upper block 23, which facilitates the assembling operation, and the number of assembling steps can be reduced.

Furthermore, no distortion is generated in the outer cylinder 11 welding is employed.

Therefore, with the structures of the outer and inner cylinders 11 and 12, the cost can be lowered, and a quality can be enhanced.

Figure 3:
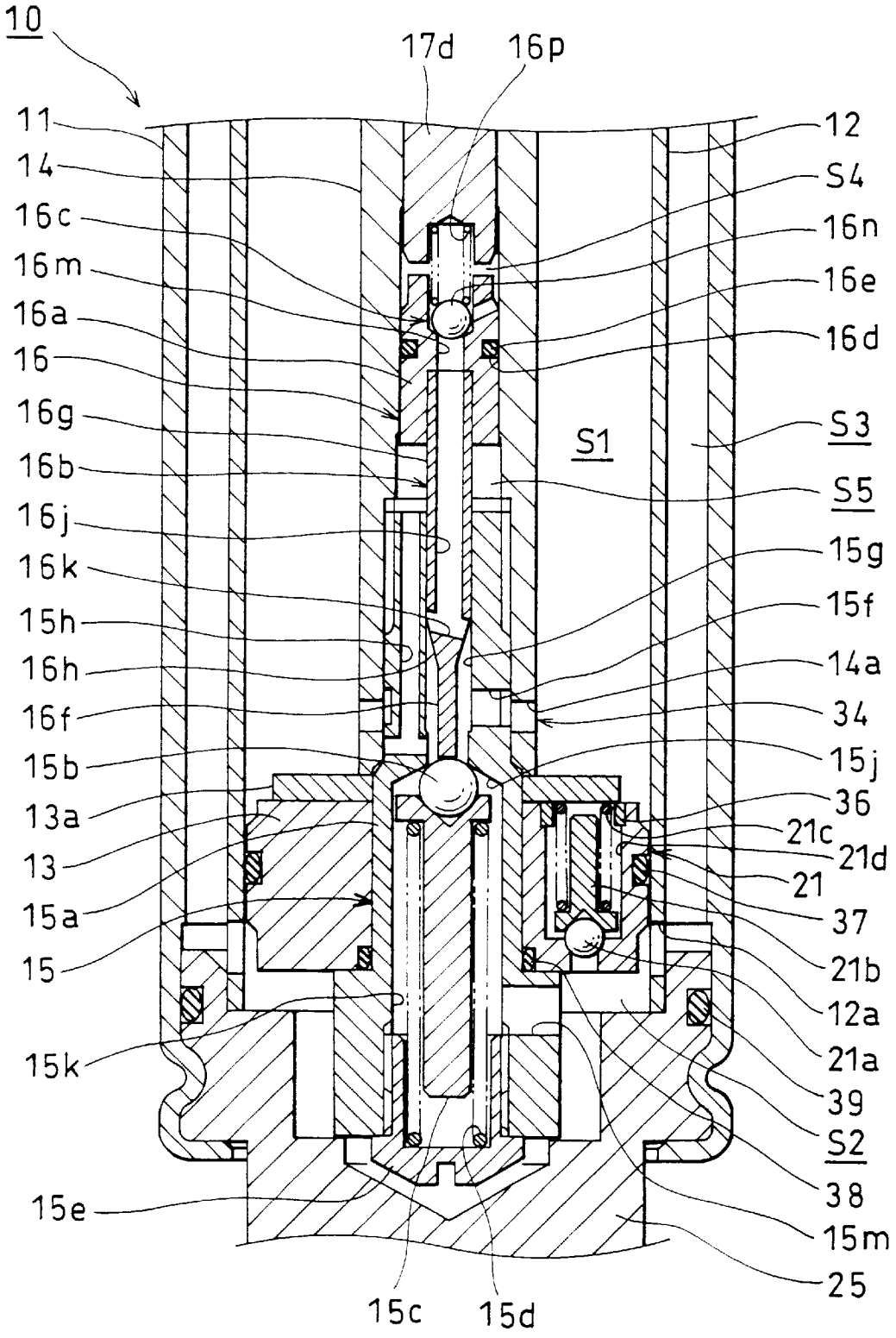
FIG. 3 is an enlargement of a lower portion of the tilt lock device shown in FIG. 2.

FIG. 3 is an enlarged sectional view of a lower portion of the tilt lock device of the present invention. The piston 13 includes a plate 13*a* between the piston 13 itself and the hollow piston rod 14 for holding an upper end of the second relief valve 21.

The hollow piston rod 14 includes a first oil passage 14*a* for connecting outer and inner peripheral portions with each other.

The piston 13 and the hollow piston rod 14 include the communication passage 34 for connecting the upper and lower oil chambers S1 and S2. The communication passage 34 is provided at its intermediate portion with the first relief valve 15.

The first relief valve 15 has a valve case 15*a* also serving as a valve seat connected to an inner periphery of the hollow piston rod 14 by a screw. A valve body 15*b* is provided in the valve case 15*a*. A spring 15*d* presses at its upper end the valve body 15*b* through a retainer 15*c*. A lower lid 15*e* supports a lower end of the spring 15*d* and closes a lower portion of the valve case 15*a*.

The valve case 15*a* has a first lateral oil passage 15*f* provided on an upper side surface of the valve body 15*b*, and a first vertical oil passage 15*g* opened above the valve body 15*b*, and a second vertical oil passage 15*h* having a lower portion communicated with a side of the first vertical oil passage 15*g* and having an upper portion opened into the hollow piston rod 14. The valve case also has a valve seat portion 15*j*, a valve chamber 15*k* for accommodating the valve body 15*b*, the retainer 15*c* and the spring 15*d*, and a second lateral oil passage 15*m* for connecting the valve chamber 15*k* and the lower oil chamber S2 together.

The communication passage 34 has the first oil 14*a* passage of the hollow piston rod 14, an inner periphery of the hollow piston rod 14 and an inner periphery of the piston 12.

The delay device 16 comprises a free piston 16*a* slidably inserted in an inner periphery of the hollow piston rod 14, a pin 16*b* integrally formed with a lower portion of the free piston 16*a* for depressing the valve body 15*b* of the first relief valve 15, and a third relief valve 16*c* incorporated in an upper portion of the free piston 16*a*.

The free piston 16*a* is provided at its outer periphery with a ring groove 16*d*, and a back-up ring 16*e* is mounted to the ring groove 16*d*. The back-up ring 16*e* includes a slit (not shown) serving as an orifice opening in a vertical direction.

The pin 16*b* has a small-diameter portion 16*f*, a large-diameter portion 16*g* and a tapered portion 16*h* connecting the small-diameter portion 16*f* and a large-diameter portion 16*g*, and includes a vertical hole 16*j* opened at an upper end of the large-diameter portion 16*g*. The tapered portion 16*h* includes an inclined hole 16*k* for bringing a lower end of the vertical hole 16*j* and an outer peripheral portion of the tapered portion 16*h* into communication with each other.

The large-diameter portion 16*g* of the pin 16*b* is slidably inserted in the first vertical oil passage 15*g* of the valve case 15*a*.

In the third relief valve 16*c*, the free piston 16*a* also serves as a valve seat, and the lower end of the spring 16*p* presses a valve body 16*n* in its closing direction against an intermediate portion of the oil passage 16*m* which is communicated from the vertical hole 16*j* of the pin 16*b* to the outer periphery of the free piston 16*a*.

An upper end of the spring 16*p* is abutted against a lower end of the operation rod 17*d* in the manual operation device 17 (see FIG. 2).

The hollow piston rod 14 is provided with an upper oil chamber S4 between the free piston 16*a* and the operation rod 17*d*, and a lower oil chamber S5 between the free piston 16*a* and the valve case 15*a*.

In the second relief valve 21, the piston 13 also serves as a valve case and a valve seat. The second relief valve 21 comprises a valve body 21*a*, a spring 21*c* for pressing the valve body 21*a* through a retainer 21*b* downward, i.e., in its closing direction, a valve chamber 21*d* accommodating the valve body 21*a*, the retainer 21*b* and the spring 21*c*, and an oil passage (not shown) leading from the valve chamber 21*d* to the upper oil chamber S1. The reference number 36 denotes a ring for positioning an upper end of the spring 21*c*, and the reference numbers 37, 38 and 39 denote O-rings.

Figure 4A:
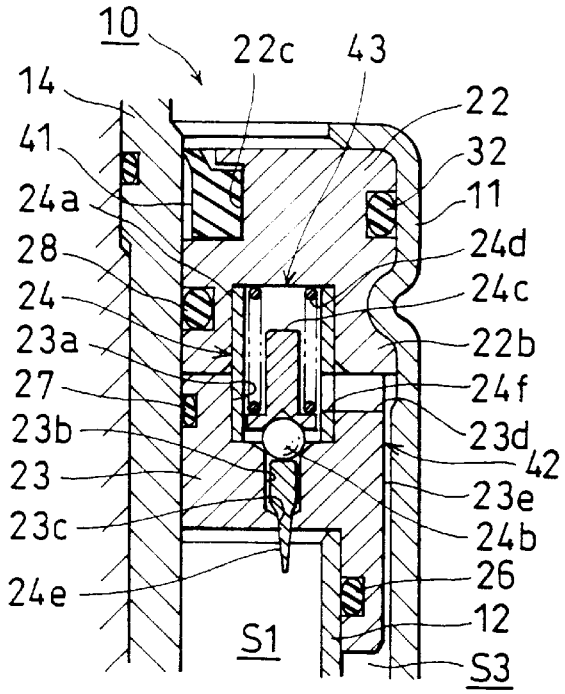
FIGS. 4A to 4C are views for explaining a vent valve of the invention.
Figure 4B:
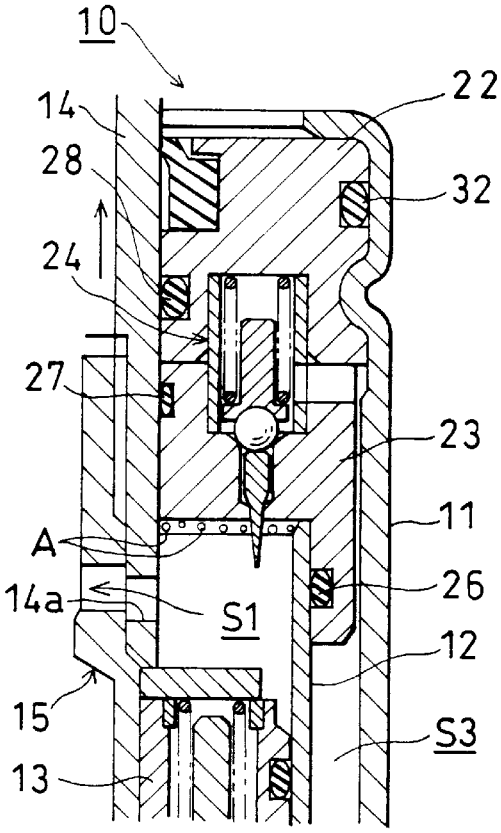
Figure 4C:
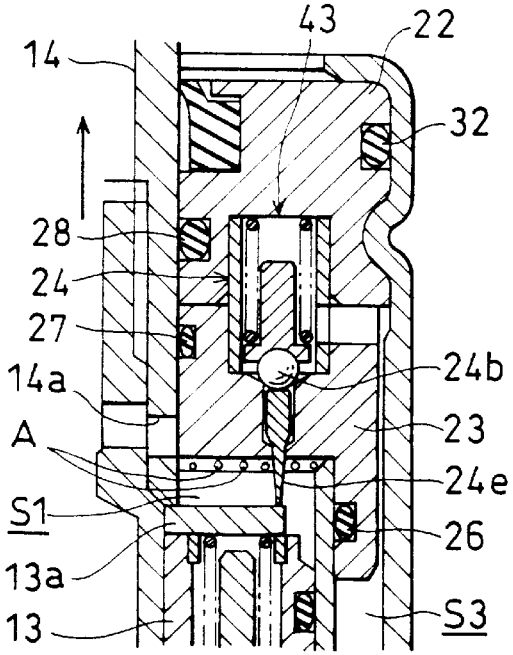
Figure 4D:
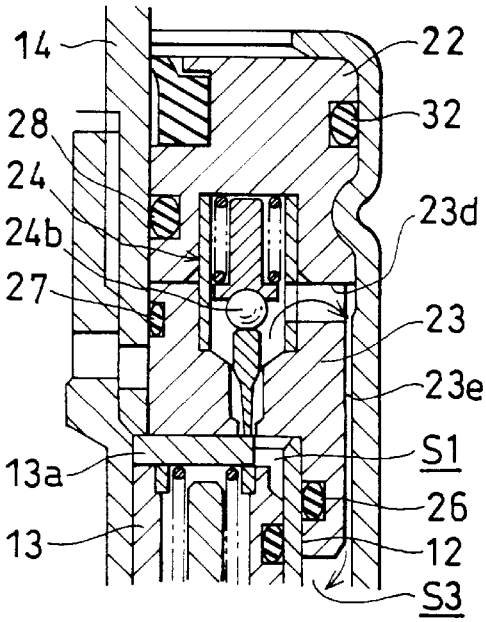

FIGS. 4A to 4D show a vent valve of the present invention, wherein FIG. 4A is an enlarged sectional view of a portion indicated by 4 in FIG. 2, and showing a state where the vent valve is closed. FIG. 4B shows a state where the piston rises halfway, FIG. 4C shows a state where a plate is abutted against a pushrod, and FIG. 4D shows a state where the vent valve is opened and the piston rises up to the uppermost position.

In FIG. 4A, the rod guide 22 is provided at is lower portion with a recess 22*b* opened downwardly, and at its upper portion with a recess 22*c* for accommodating a dust seal 41.

The upper block 23 includes a recess 23*a* upwardly opened at an upper portion of the upper block 23, a large-diameter hole 23*b* and a small-diameter hole 23*c* for connecting a lower portion of the recess 23*a* and the inner cylinder 12, a lateral oil passage 23*d* leading from the recess 23*a* to the outer periphery, and a vertical oil passage 23*e* leading from the lateral oil passage 23*d* to the accumulator S3. The vertical oil passage 23*e* may be formed using a clearance between the inner periphery of the outer cylinder 11 and the outer periphery of the upper block 23.

The vent valve 24 comprises a valve case 24*a* fitted to a recess 22*b* of the rod guide 22 and a recess 23*a* of the upper block 23, a valve body 24*b* pressed against a lower end of the recess 23*a* which serves as a valve seat, a spring 24*d* depressing, at its lower end, the valve body 24*b* into its closing direction through a retainer 24*c*, and a pushrod 24*e* vertically movably inserted into the large-diameter hole 23*b* and the small-diameter hole 23*c* of the upper block 23. The reference number 24*f* denotes a penetration hole passing through an inner periphery to an outer periphery of the valve case 24*a*.

The small-diameter hole 23*c*, the large-diameter hole 23*b*, the recess 23*a*, the penetration hole 24*f*, the lateral oil passage 23*d* and the vertical oil passage 23*e* form a through-hole 42 connecting the upper portion of the inner cylinder 12 and the accumulator S3.

The recess 23*a* of the upper block 23, the valve case 24*a*, the valve body 24*b*, the retainer 24*c*, the spring 24*d*, and the recess 22*b* of the rod guide 22 form a fourth relief valve 43.

Since the vent valve 24 is disposed between the rod guide 22 and the upper block 23 in this manner, the vent valve 24 can be mounted easily. Bolts and nuts for mounting the vent valve 24 are unnecessary, and it is unnecessary to use fasteners therefore, the costs will be reduced.

The operation of the above described vent valve 24 will be explained next.

In FIG. 4A, if air A (see FIG. 4B) is mixed in the upper oil chamber S1 when the tilt lock device 10 is assembled, the lower block 25 shown in FIG. 2 is fixed, the first relief valve 15 is opened by the manual operation device 17 for connecting the upper and lower oil chambers S1 and S2 with each other, and the hollow piston rod 14 and the piston 13 are slowly lifted up as shown in FIG. 4B.

At that time, the hydraulic fluid in the upper oil chamber S1 passes through the first oil passage 14*a* of the hollow piston rod 14 and the first relief valve 15, and reaches in the lower oil chamber S2 (see FIG. 3).

In FIG. 4C, the hollow piston rod 14 and the piston 13 are further lifted up, the first oil passage 14*a* of the hollow piston rod 14 moves to the side of the upper block 23, and the plate 13*a* of the piston 13 abuts against the lower end of the pushrod 24*e* of the vent valve 24 just before the first oil passage 14*a* is closed.

Then, the upper end of the pushrod 24*e* abuts against the valve body 24*b*.

In FIG. 4D, if the piston 13 is further lifted up, the pushrod 24*e* depresses the valve body 24*b* and the vent valve 24 starts opening. Therefore, the air A (see FIG. 4C) in the upper oil chamber S1 escapes from the vent valve 24 into the accumulator S3 through the lateral oil passage 23*d* and the vertical oil passage 23*e* of the upper block 23.

Lifting movement of the piston 13 is continued until the plate 13*a* of the piston 13 abuts against the upper block 23.

As described above, in FIG. 4A, the through-hole 42 is formed between the upper portion of the inner cylinder 12 and the accumulator S3, and the vent valve 24 is provided to an intermediate portion of the through-hole 42 and includes the pushrod 24*e* abutting against the lifted piston 13 and then moving, and the fourth relief valve 43 for releasing the air A (see FIG. 4B) from the upper portion of the inner cylinder 12 into the accumulator S3 through the pushed and opened valve body 24*b*. That is, the piston 13 is lifted up, the piston 13 is abutted against the pushrod 24*e*, the fourth relief valve 43 is opened to release the air A (see FIG. 4B) in the upper portion of the inner cylinder 12 into the accumulator S3. As compared with the conventional device in which a number of steps are repeated for releasing the air accumulated in the cylinder such as a step of reciprocating the air within the piston many times and a step for turning the tilt lock device upside down at the time of assembling the tilt lock device, the vent valve 24 can be opened only by pulling up the piston 13, and air is removed easily.

Therefore, the number of air releasing steps can be decreased, the quality of the tilt lock device 10 can be enhanced, and the costs of manufacture can be reduced.

During the above described air releasing steps, even if the air A (see FIG. 4C) in the upper oil chamber S1 enters in the first relief valve 15 (see FIG. 3) or the lower oil chamber S2 (see FIG. 3), if a step of depressing the piston 13 is added to the above described steps and such steps are repeated several times, the air A (see FIG. 4C) in the first relief valve 15 or the lower oil chamber S2 is moved into the accumulator S3 through the communication hole 12*a* provided at the lower end of the inner cylinder 12 during the step of depressing the piston 13 and therefore, there is no problem.

In a state where the vent valve 24 shown in FIG. 4A is closed, the upper portion of the inner cylinder 12, i.e., the upper portion of the upper oil chamber S1 and the upper portion of the accumulator S3 are out of communication because of the O-rings 26, 27, 28 and 32 shown in FIG. 2.

The O-ring 27 provided in the penetration hole 23*b* of the upper block 23 and the O-ring 28 provided in the penetration hole 22*a* of the rod guide 22 are not subjected to many strokes, and these O-rings tightly seal the hollow piston rod 14 while sliding.

Since there are provided the O-rings 28 and 27 as sealing members which seal the clearance between the hollow piston rod 14 and the penetration holes 22*a* and 23*b* with respect to the rod guide 22 and the upper block 23 as closing members which have penetration holes 22*a* and 23*b* into which the hollow piston rod 14 passes through, and for closing the upper portion of the inner cylinder 12, when the vent valve 24 is not operated, the communication between the upper portion of the inner cylinder 12, i.e., the upper oil chamber S1 and the upper portion of the accumulator S3 is cut off. Therefore, the hydraulic fluid in the upper portion of the inner cylinder 12 and the accumulator S3 is not communicated.

Therefore, a tilt lock state which is the essential function of the tilt lock device 10 can be maintained. The manual operation of the above described tilt lock device 10 will be explained next.

Figure 5B:
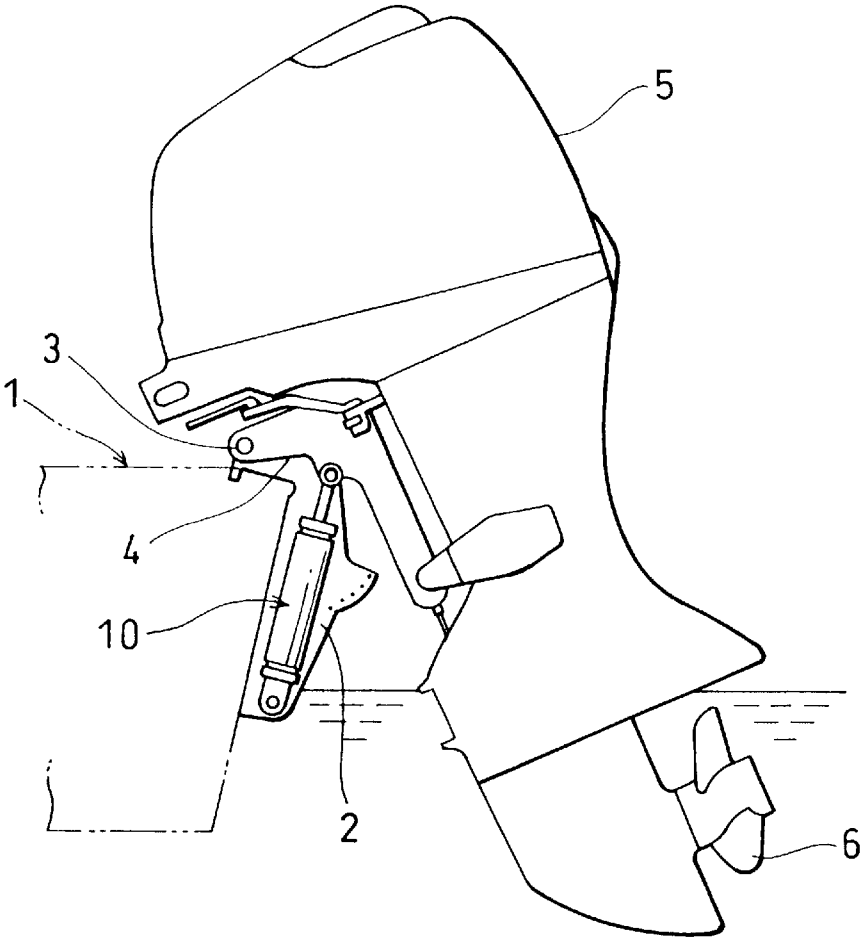
FIGS. 5A and 5B are views for explaining a manual operation of the tilt lock device of the invention.
Figure 5A:
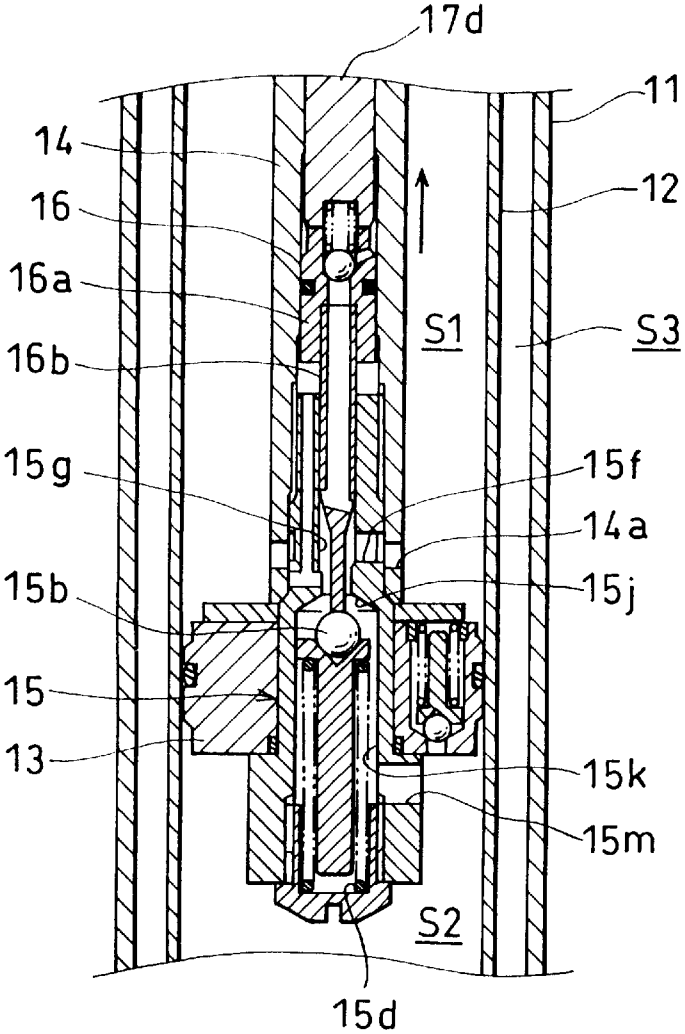

FIGS. 5A and 5B are views for explaining the manual operation of the tilt lock device of the invention, in which FIG. 5A shows a state where the first relief valve 15 is opened, and FIG. 5B shows a tilt state of the outboard motor.

For example, when the boat advances in the shallow, it is necessary to tilt up the outboard motor 5 such that the lower end of the outboard motor 5 does not strike with the bottom of the sea or river as shown in FIG. 5B.

In such a case, in FIG. 2, the exclusive handle is put on the hexangular end 17*e* of the camshaft 17*b* of the manual operation device 17, and is rotated.

With this operation, the operation rod 17*d* is lowered by the cam portion 17*c* of the camshaft 17*b*.

In FIG. 5A, by lowering the operation rod 17*d*, a lower end of the operation rod 17*d* abuts against the free piston 16*a* of the delay device 16, the pin 16*b* is lowered to push down the valve body 15*b* of the first relief valve 15. With this operation, the first relief valve 15 is opened, the upper oil chamber S1 is brought into communication with the lower oil chamber S2 through the first oil passage 14*a* of the hollow piston rod 14, the first lateral oil passage 15*f* of the first relief valve 15, the first vertical oil passage 15*g*, the valve chamber 15*k* and the second lateral oil passage 15*m*, so that the hollow piston rod 14 and the piston 13 can move vertically.

In FIG. 5B, the outboard motor 5 is inclined upward through a desired angle by the manual operation while maintaining the state shown in FIG. 5A.

At that time, since a tension force is applied to the tilt lock device 10, the piston 13 shown in FIG. 5A rises, and pressure in the upper oil chamber S1 is increased. Therefore, the hydraulic fluid in the upper oil chamber S1 flows into the lower oil chamber S2 through the first oil passage 14*a* of the hollow piston rod 14, the first lateral oil passage 15*f* of the first relief valve 15, the first vertical oil passage 15*g*, the valve chamber 15*k* and the second lateral oil passage 15*m*.

At that time, since the gas pressure in the accumulator S3 assists the extension of the tilt lock device 10 (see FIG. 5B), the above described tilting up operation can be carried out, with ease.

After that, the camshaft 17*b* of the manual operation device 17 shown in FIG. 2 is again rotated to rise the operation rod 17*d*.

With these operations, the operation rod 17*d* is separated from the free piston 16*a* as shown in FIG. 5A, and the pin 16*b* is separated from the valve body 15*b*.

With this operation, the valve body 15*b* engages the valve seat 15*j* by a resilient force of the spring 15*d*, and the first relief valve 15 is closed.

Therefore, the hydraulic fluid can not flow between the upper and lower oil chambers S1 and S2, the piston can not move vertically, and the tilt lock state is established.

With such an operation, the boat can advance in the shallow. When landing the boat, the outboard motor 5 (see FIG. 5B) is inclined substantially horizontally by the manual operation of the above described tilt lock device 10 (see FIG. 2), and such state can be maintained.

To return the outboard motor 5 into a substantially vertical state as shown in FIG. 1, the first relief valve 15 may be opened and closed by the above described manual operation. At that time, the hydraulic fluid in the inner cylinder 12 flows through the passages oppositely from the case in which the outboard motor 5 is tilted up.

The automatic operation of the above described tilt lock device 10 will be explained next.

Figure 6B:
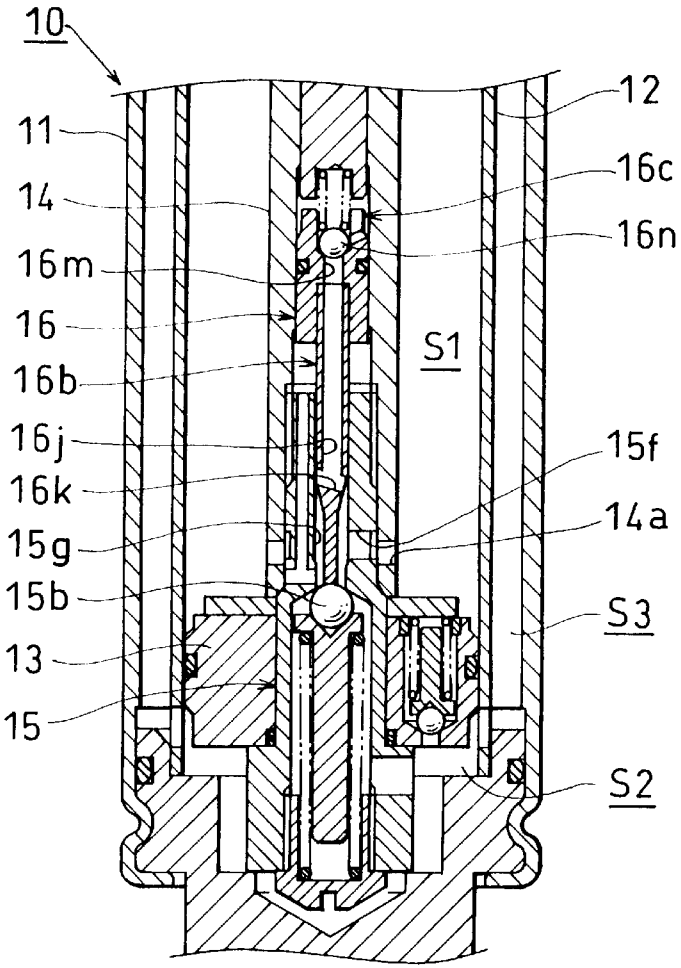
FIGS. 6A and 6B are views (the first half) for explaining an automatic operation of the tilt lock device of the invention.
Figure 6A:
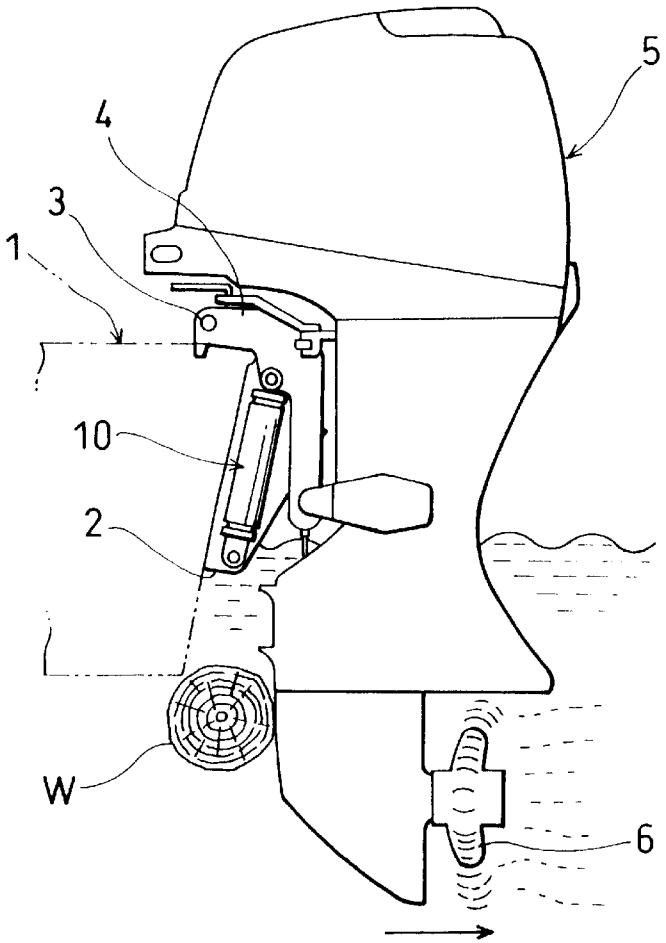

FIGS. 6A and 6B are views (the first half) showing the automatic operation of the tilt lock device of the invention, wherein FIG. 6A shows a state where an external force is applied to the outboard motor, and FIG. 6B shows the result of a pressure change in the upper oil chamber.

Figures 7A, 7B, 7C:
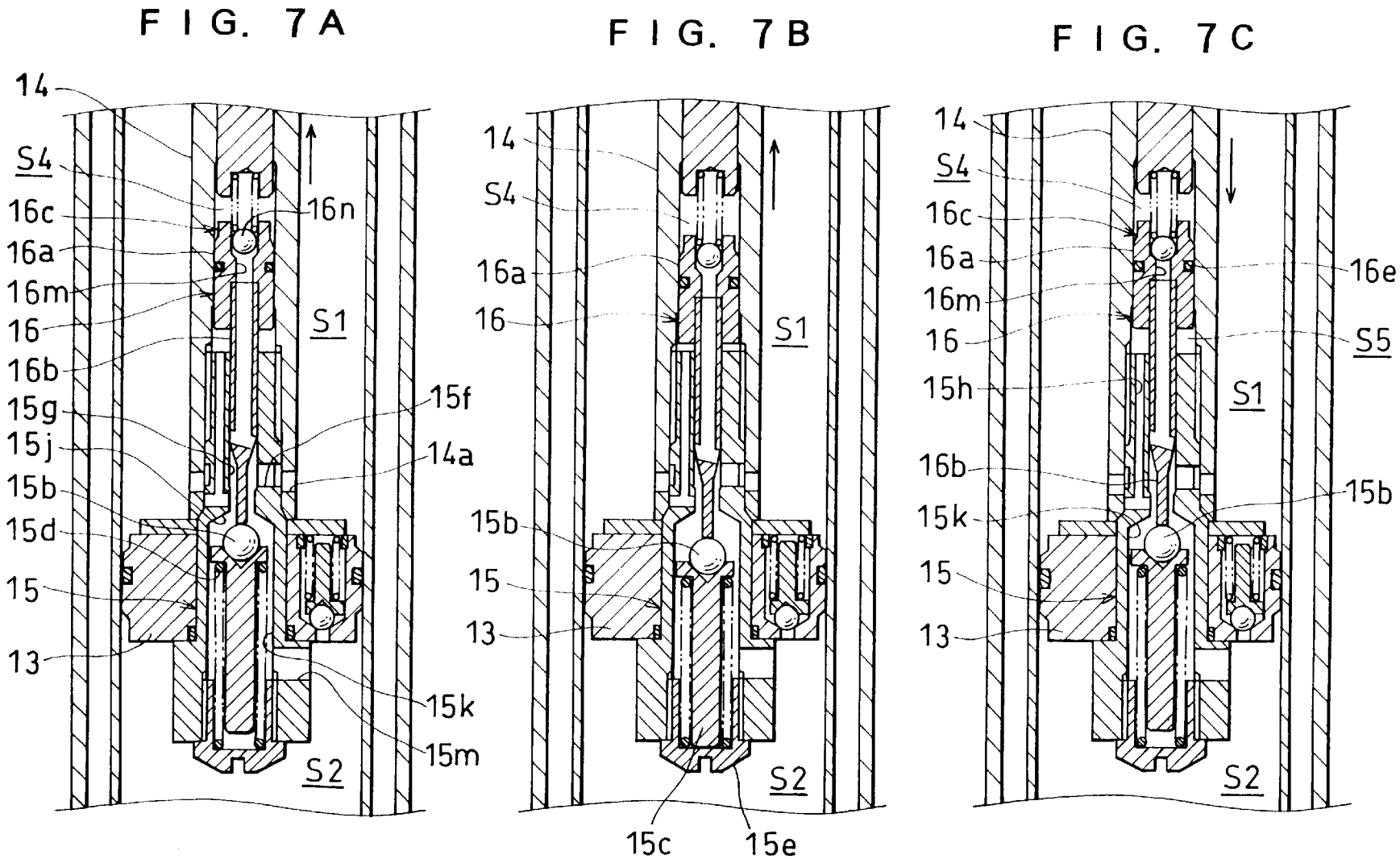
FIGS. 7A to 7C are views (the second half) for explaining the automatic operation of the tilt lock device of the invention.

FIGS. 7A to 7C are views (the second half) explaining the automatic operation of the tilt lock device of the invention, wherein FIG. 7A shows a state just after the first and third relief valves are opened, FIG. 7B shows a state where the first relief valve is further opened and the free piston is moved downward, and FIG. 7C shows a state where the delay device is operated.

In FIG. 6A, when a driftwood or log W collides against a front portion of the outboard motor 5 during travel, a rearward force is applied to the lower portion of the outboard motor 5, and a tension force is applied to the tilt lock device 10.

In FIG. 6B, by the tension force to the tilt lock device 10, the piston 13 tends to rise, and pressure in the upper oil chamber S1 is increased.

This pressure is transmitted into the first vertical oil passage 15*g* through the first oil passage 14*a* of the hollow piston rod 14 and the first lateral oil passage 15*f* of the first relieve valve 15 to depress the valve body 15*b*.

Further, this pressure is transmitted to the oil passage 16*m* through the first oil passage 14*a* of the hollow piston rod 14, the first lateral oil passage 15*f* of the first relieve valve 15, the first vertical oil passage 15*g*, the inclined hole 16*k* of the delay device 16 and the vertical hole 16*j* to push up the valve body 16*n* of the third relief valve 16*c*.

In FIG. 7A, if the pressure in the upper oil chamber S1 exceeds a predetermined value, i.e., the value=(a pressure in the lower oil chamber S2)+(a set load of the spring 15*d* of the first relief valve 15)/(a cross section of contact portions of the valve body 15*b* and the valve seat 15*j*), the first relief valve 15 is opened.

If the first relief valve 15 is opened, the piston 13 and the hollow piston rod 14 start rising, and the hydraulic fluid in the upper oil chamber S1 starts flowing into the lower oil chamber S2 through the first oil passage 14*a* of the hollow piston rod 14, the first lateral oil passage 15*f* of the first relieve valve 15, the first vertical oil passage 15*g*, the valve chamber 15*k* and the second lateral oil passage 15*m*.

The pin 16*b* and the free piston 16*a* of the delay device 16 are lowered as the valve body 15*b* is lowered, and the hydraulic fluid in the oil passage 16*m* of the free piston 16*a* pushes and opens the valve body 16*n* of the third relief valve 16*c*, and flows into the upper oil chamber S4 in the rod.

In FIG. 7B, when a shock applied to the outboard motor 5 (see FIG. 6A) is great, the piston 13 and the hollow piston rod 14 further rise, the pressure in the upper oil chamber S1 is further increased, an amount of the hydraulic fluid flowing into the lower oil chamber S2 from the upper oil chamber S1 is increased, the valve body 15*b* of the first relief valve 15 is further lowered, the lowering movement of the valve body 15*b* is stopped at the point where the lower end of the retainer 15*c* touches the lower lid 15*e*, and at the same time, the lowering movement of the free piston 16*a* is stopped.

When the external force is not applied to the outboard motor 5 (see FIG. 6A) any more, in FIG. 7C, the piston 13 and the hollow piston rod 14 do not rise further, the pressure in the upper oil chamber S1 is reduced, the pressure in the oil passage 16*m* of the free piston 16*a* is also reduced and therefore, the third relief valve 16*c* is closed.

Although the first relief valve 15 tends to close, the hydraulic fluid in the upper oil chamber S4 in the rod gradually flows into the valve chamber 15*k* through the lower oil chamber S5 in the rod and the second vertical oil passage 15*h* from the orifice provided in the back-up ring 16*e*, the pins 16*b* and the free piston 16*a* which depressed the valve body 15*b* rise slowly and delay the closing timing of the first relief valve 15.

While the first relief valve 15 is opened, since a compressing force is applied to the tilt lock device 10 by a self-weight of the outboard motor 5 (see FIG. 6A), the pressure in the lower oil chamber S2 is increased, and hydraulic fluid flows into the upper oil chamber S1 through the first relief valve 15 from the lower oil chamber S2, and the piston 13 and the hollow piston rod are lowered.

Therefore, in FIG. 6A, when the outboard motor 5 strikes driftwood W, the tilt lock device 10 can automatically expand to moderate the shock and to prevent the outboard motor 5 from being damaged.

Further, since the delay device 16 is provided, if a rearward force ceases to be exerted on the outboard motor 5 after the tilt lock device 10 expands and the outboard motor 5 is inclined, the tilt lock device 10 slowly shrinks by the weight of the outboard motor 5 itself and therefore, the outboard motor 5 can automatically return to the original substantially upright state as illustrated.

The operation of the second relief valve will be explained.

Figure 8:
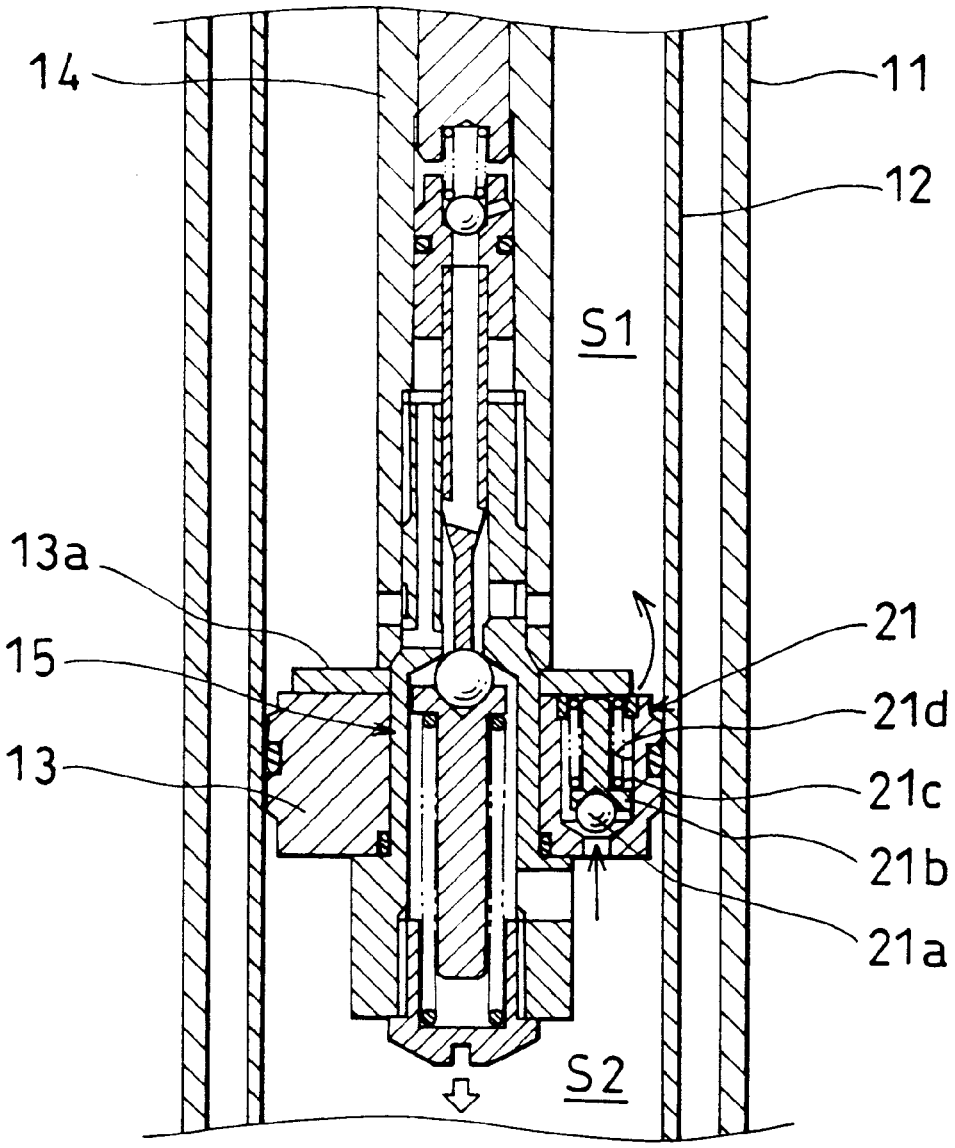
FIG. 8 is a sectional view showing a function of a second relief valve of the invention.

FIG. 8 is a sectional view showing the operation of the second relief valve of the present invention.

As shown in FIG. 5B, in the circumstance where after the boat runs in the shallow with the outboard motor 5 being tilted, the boat then advances offshore with the outboard motor 5 being turned substantially uprightly and starts normal running as shown in FIG. 1.

At that time, the output of the outboard motor 5 is increased. With this, in FIG. 5B, a forward force of the boat body is applied to the low portion of the outboard motor 5 by the increased propulsive power of the outboard motor 5.

For this reason, a compression force is applied to the tilt lock device 10.

In FIG. 8, the pressure in the lower oil chamber S2 is increased by the compression force of the tilt lock device 10, and when a difference in pressure between this pressure and a pressure in the upper oil chamber S1 exceeds the predetermined value, the second relief valve 21 is opened. The hydraulic fluid in the lower oil chamber S2 flows into the upper oil chamber S1 through the valve chamber 21*d* of the second relief valve 21 and an oil passage (not shown). Therefore, the piston 13 is lowered, and the outboard motor 5 shown in FIG. 5B returns to a substantially original state shown in FIG. 1.

The tilt lock device of the outboard motor of the present invention should not be limited to the outboard motor, and it can be employed other hoisting and lowering devices also.

By the above described structure, the present invention exhibits the following effects.

The tilt lock device of the present invention comprises the piston having the piston rod, the inner cylinder vertically movably accommodating the piston therein and defined therein into the upper and lower oil chambers by the piston, and the outer cylinder surrounding the inner cylinder. The communication passage for bringing the upper and lower oil chambers into communication with each other is formed in the piston. Disposed in the communication passage is the on-off relief valve which can be operated from outside and prevents the oil from flowing from the lower oil chamber to the upper oil chamber, and which serves as a shock absorbing valve for allowing the oil to flow from the upper oil chamber to the lower oil chamber when a pressure in the upper oil chamber exceeds a set pressure, thereby absorbing a shock. The accumulator chamber is formed between the outer cylinder and the inner cylinder for also serving as the volume compensating chamber to control the volume of the oil passing in and out through the lower oil chamber to follow the in-and-out movement of the piston rod. Therefore, space occupied by the tilt lock device is reduced, and a length required for mounting the tilt lock device is also reduced. Further, an external communication passage to be connected to the outside from the outer and inner cylinders is unnecessary.

Therefore, a flexibility in design for mounting the tilt lock device between the stem and the outboard motor is enhanced and thus, a flexibility in design of shapes of the stern bracket, the swivel bracket and the outboard motor to be mounted to the opposite ends of the tilt lock device is also enhanced.

Further, the tilt lock device itself is compact, the length required for mounting the same is reduced and therefore, it is easy to transport or handle the device at the time of maintenance before assembling the device.

Furthermore, since an external communication passage is unnecessary, it is unnecessary to install pipe nor to cast and mold a communication passage integrally in a side of the cylinder. The tilt lock device can be assembled easily and production cost is reduced.

From the above reasons, the cost required for the outboard motor including the tilt lock device and brackets can be reduced.

Furthermore, in the tilt lock device of the present invention, the through-hole is formed between the upper portion of the inner cylinder and the accumulator chamber, and a vent valve is provided to an intermediate portion of the through-hole and involves the pushrod abutting against the lifted piston and moving, and the relief valve for releasing air in upper portion of the inner cylinder into the accumulator chamber through the pushed and opened valve body in reaction to the pushrod. That is, since the piston is lifted up, the piston is abutted against the pushrod, the relief valve is opened to release air into the accumulator chamber, air is removed easily.

Therefore, the number of air releasing steps can be decreased, the quality of the tilt lock device can be enhanced, and production costs are reduced.

In, the tilt lock device of the present invention, since there are provided sealing members which seal the clearance between the piston rod and the penetration holes with respect to the closing members which have the penetration holes into which the piston rod passes through, and for closing the upper portion of the inner cylinder, when the vent valve is not operated, the communication between the upper portion of the inner cylinder and the upper portion of the accumulator chamber is cut off. Therefore, the hydraulic fluid in the upper portion of the inner cylinder and the accumulator chamber is not communicated.

Therefore, a tilt lock state which is the essential function of the tilt lock device can be maintained.

While the preferred embodiments of the invention have been described in detail with reference to the drawings, they are by no means limitative, and various changes and modifications are possible without departing from the scope and spirit of the invention.

Although the invention has been illustrated and described with respect to several exemplary embodiments thereof, it should be understood by those skilled in the art that the foregoing and various other changes, omissions and additions may be made to the present invention without departing from the spirit and scope thereof. Therefore, the present invention should not be understood as limited to the specific embodiment set out above but to include all possible embodiments which can be embodied within a scope encompassed and equivalents thereof with respect to the feature set out in the appended claims.

What is claimed is:

1. A tilt lock device for an outboard motor in which an outboard motor is mounted to a boat stem, and which can be stopped at an arbitrary position when the motor is swung from its in-use position to its stand-by position, a tilt lock device is interposed between said stern and said motor in order to moderate a shock applied to said motor during travel and wherein said tilt lock device comprises a piston having a piston rod, an inner cylinder accommodating said piston for vertical movement and defining with said piston an upper oil chamber and a lower oil chamber, and an outer cylinder surrounding said inner cylinder, a communication passage formed in said piston for bringing said upper and lower oil chambers into communication with each other, an on-off valve capable of being operated from outside said cylinders and being disposed in said communication passage to prevent oil from flowing from said lower oil chamber into said upper oil chamber, and for also serving as a shock absorbing valve which allows oil to flow from said upper oil chamber to said lower oil chamber when pressure in said upper oil chamber exceeds a set pressure so as to absorb a shock, an accumulator chamber formed between said outer and inner cylinders for also serving as a volume compensation chamber which controls the volume of oil going in and out through said lower oil chamber in response to in-and-out movement of said piston rod.

2. A tilt lock device for an outboard motor according to claim 1, wherein a through-hole is formed between an upper portion of the inner cylinder and said accumulator chamber, said tilt lock device further comprises a vent valve for an intermediate portion of said through-hole, and including a pushrod adapted to abut said piston, and a relief valve for releasing air from the upper portion of the inner cylinder into said accumulator chamber through a valve body pushed and opened by said pushrod.

3. A tilt lock device for an outboard motor according to claim 2, wherein a closing member having a penetration hole through which said piston rod passes and closes an upper portion of said inner cylinder is provided with a sealing member for sealing a clearance between said piston rod and said penetration hole, so that when said vent valve is not operated, the communication between the upper portion of said inner cylinder and said accumulator chamber is cut off.

* * * * *